US006419529B1

(12) United States Patent
Shi et al.

(10) Patent No.: US 6,419,529 B1
(45) Date of Patent: Jul. 16, 2002

(54) SIDE-BY-SIDE ELECTRICAL CONNECTOR ASSEMBLY

(75) Inventors: Guang Xing Shi; Guo Zeng Zhang, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/952,289

(22) Filed: Sep. 13, 2001

(30) Foreign Application Priority Data

Jun. 27, 2001 (TW) ..... 90210706

(51) Int. Cl.[7] ..... H01R 13/502
(52) U.S. Cl. ..... 439/701; 439/607
(58) Field of Search ..... 439/701, 541.5, 439/607, 608, 609, 610

(56) References Cited

U.S. PATENT DOCUMENTS 6,132,254 A * 10/2000 Wu ..... 439/607
6,213,813 B1 * 4/2001 Huang ..... 439/541.5
6,227,880 B1 * 5/2001 Zhu et al. ..... 439/607
6,319,061 B1 * 11/2001 Chen et al. ..... 439/607

* cited by examiner

*Primary Examiner*—Hien Vu
(74) *Attorney, Agent, or Firm*—Wei Te Chung

(57) ABSTRACT

An electrical connector assembly comprising: a pair of electrical connectors each including an insulative housing, a front shell having a pair of side walls, a rear shell and a plurality of terminals for soldering to a printed circuit board. An ear portion extends from one of the side walls of each front shell and has a through hole. The through holes are aligned with each other. An insulative board is formed between the insulative housings and extends forward. A hole is formed on a front face of the insulative board and aligned with the through holes for receiving a fastener extending through an electrical device shell.

6 Claims, 4 Drawing Sheets

SIDE-BY-SIDE ELECTRICAL CONNECTOR ASSEMBLY

BACKGROUND OF THE INVENTION

1. Field of The Invention

The present invention relates to an electrical connector assembly, and particularly to an universal serial bus (USB) connector assembly which has two side-by-side connectors assembled together.

2. Brief Description of The Prior Art

Conventional USB connector assembly is disclosed in U.S. Pat. No. 6,224,422. The connector assembly comprises a pair of electrical connectors each has an insulative housing, a front shell, a rear shell and a plurality of terminals. The insulative housing consists of a thick rear section and a thin front section extending forward from the rear section. The terminals are received in the insulative housing. The insulative housing is inserted into the rear shell, and the front section of the insulative housing is inserted into the front shell. A cross member is formed between the rear sections of the insulative housings. The rear shell has a latch tongue which mounts the connector assembly on a print circuit board (PCB). The latch tongue and the terminals are also soldered on the PCB for a more secure mounting. However, the front section of the insulative housing enclosed by the front shell is suspended over the PCB and is easy to vibrate, whereby the soldered connector assembly trend to be deformed by unexpected external force.

Hence, an improved electrical connector assembly is required to overcome the disadvantages of the prior art.

BRIEF SUMMARY OF THE INVENTION

The object of the present invention is to provide an electrical connector assembly having a pair of USB connectors formed side-by-side and can be mounted on electrical elements securely and not easy to be deformed by unexpected external force.

An electrical connector assembly according to the present invention comprises: a pair of electrical connectors each includes an insulative housing, a front shell having a pair of side walls, a rear shell and a plurality of terminals for soldering to a printed circuit board, an ear portion extends from one of the side walls of each front shell and has a through hole, the through holes being aligned with each other, an insulative board is formed between the insulative housings and extends forward, a hole is formed on a front face of the insulative board and aligned with the through holes for receiving a fastener extending through an electrical device shell.

Other objects, advantages and novel features of the invention will become more apparent from the following detailed description when taken in conjunction with the accompanying drawings.

DETAILED DESCRIPTION OF THE INVENTION

Figure 1:
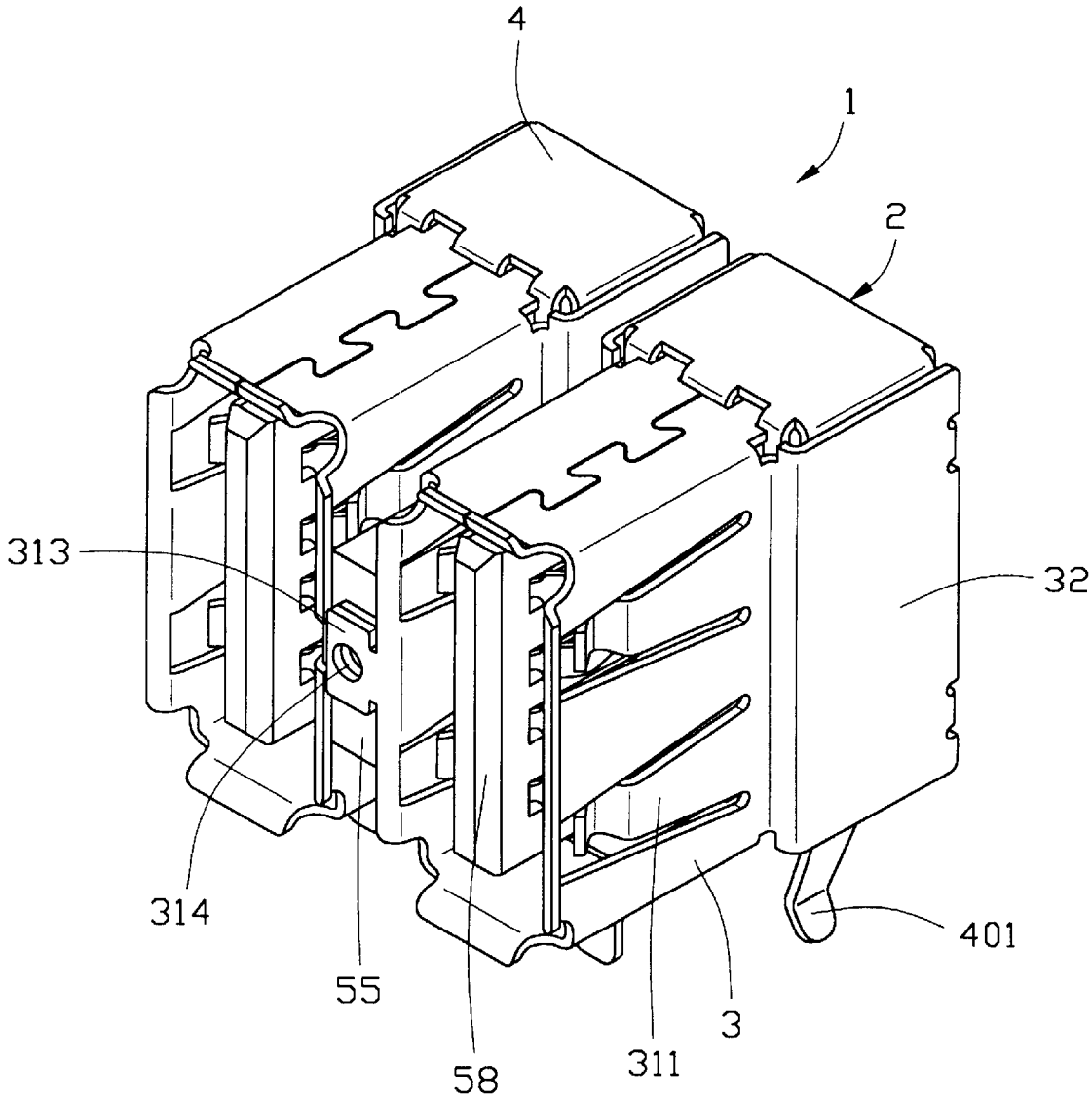
FIG. 1 is a perspective view of an electrical connector assembly of the present invention.
Figure 2:
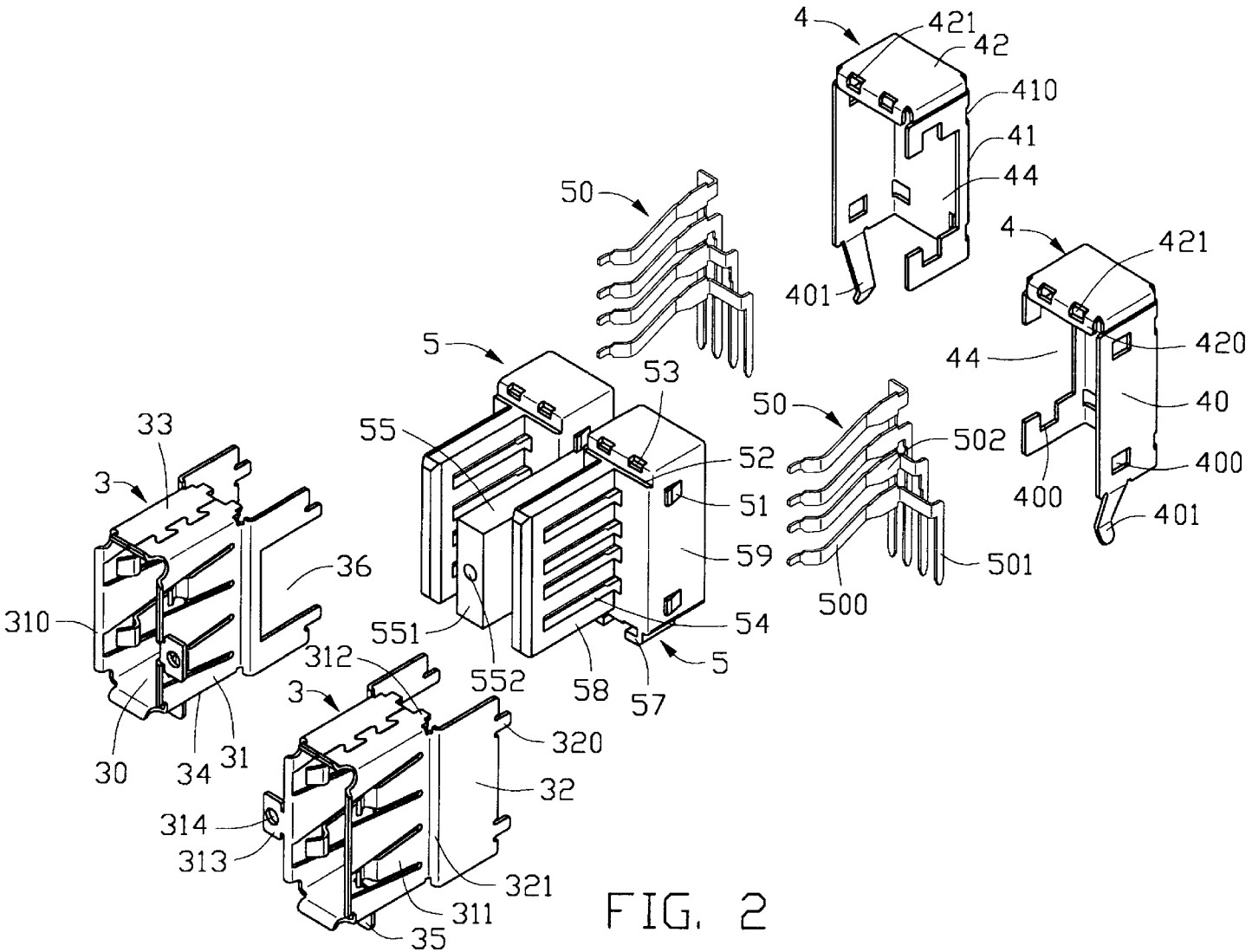
FIG. 2 is an exploded view of an electrical connector assembly of the present invention.

Referring to FIGS. 1 and 2, an electrical connector assembly 1 of the present invention comprises a pair of electrical connectors 2 each have a rectangular front shell 3, a rear shell 4, an insulative housing 5 and four terminals 50. The front shells 3 each includes a receiving opening 30 enclosed by a pair of side walls 31, a top wall 33 and a bottom wall 34. A guiding portion 310 has four parts respectively extending outward from forward edges of the side walls 31, the top wall 33 and the bottom wall 34 for guiding a mating electrical connector into the receiving opening 30. An ear portion 313 extends outward from the guiding portion 310 with a through hole 314 formed thereon. A plurality of strips 311 is stampingly formed in the side walls 31 with a curved end, whereby the resilient strips 311 press against a mating electrical connector making reliable contact and enduring many cycles. A pair of tabs 312 extends rearward from a rear edge of the top wall 33. A pair of parallel inserting plates 32 extends from a rear edge of each side wall 31, each front shell 3 defines a first cutout 36 in the opposite inner inserting plates 32, an inclined portion 321 forming the transition between the side walls 31 and the corresponding inserting plates 32. A pair of latching fingers 320 extends rearwardly from a rear edge of each inserting plate 32. A first standoff 35 bends and depends downward from the bottom wall 34.

The rear shell 4 unitarily formed includes a top wall 42 and a pair of side walls 40. A flange 420 depends downward from a front edge of the top wall 42, and a pair of first recesses 421 is defined therein. A pair of apertures 410 is defined at each of opposite edges of the rear wall 41 and adjacent the side walls 40 of the rear shell 4, and correspondingly receiving the latching fingers 320 of the inserting plates 32 of the front shell 3. The side walls 40 each define a second cutout 44 and a plurality of latching holes 400 therein and cooperate with the inserting plates 32 of the front shell 3. A pair of latching tongues 401 substantially L-shaped bends and extends from a bottom edge of opposite outer side walls 40 of the rear shells 4, respectively. The latching tongues 401 tightly secure the electrical connector to a printed circuit board and facilitate stamping manufacture.

Referring to FIG. 2, a pair of insulative housings 5 each consists of a thick rear section 59 and a thin front section 58 extending forward from the rear section 59. Four passageways 54 are defined in the front section 58 for receiving four terminals 50. A plurality of latches 51 disposed on each of opposite sides of the rear section 59 is adapted for mating with the latching holes 400 in the rear shell 4. A step 52 is formed between the front section 58 and the rear section 59 for mating with the flange 420 of the rear shell 4. A pair of second recesses 53 defined in a top front edge of the rear section 59 adjacent the front section 58 corresponds to the first recesses 421 in the rear shell 4 and the tabs 312 of the front shell 3. The rear section 59 has a pair of second standoffs 57 on a bottom surface thereof to fit against the front shell 3. An elongated insulative board 55 is formed between the rear sections 59 of two insulative housings 5 and extends frontwardly parallel to the front sections 58. A threaded hole 552 is formed on a front face 551 of the insulative board 55. Each terminal 50 comprises a signal contact 500 at one end, a soldering tail 501 at an opposite end and a retaining portion 502 therebetween adjacent the signal contact 500. The signal contacts 500 received in the passageways 54 mates with the contacts of a mating electrical connector. The retaining portions 502 are substantially planar and formed to secure the terminals 50 in the passageways 54. The soldering tails 501 extend from one end of the retaining portions 502.

During assembly, first the terminals 50 are received in the passageways 54 of the insulative housing 5. The insulative housings 5 each is inserted into the rear shell 4, the latches 51 on the insulative housing 5 locking with the latching holes 400 in the rear shell 4, the insulative board 55 partly receiving into the second cutout 44, and the flange 420 of the rear shell 4 mating with the step 52 of the insulative housing 5. Then, the front section 58 of each insulative housing 5 is inserted into the receiving opening 30 of the front shell 3. The rear section 59 of the insulative housing 5 and the rear shell 4 are received between the inserting plates 32. The tabs 312 of the front shell 3 are inserted into the first recesses 421 in the rear shell 4 and the second recesses 53 in the insulative housing 5. Moreover, the latching fingers 320 of the front shell 3 are bent inward and inserted into the apertures 410 in the rear shell 4 locking the front shell 3 to the rear shell 4 and the insulative housing 5. The ear portions 313 of the front shells 3 align each other and communicated with the front face 551 of the insulative board 5, the through holes 314 is align with each other and align with the threaded hole 552 on the insulative board 5.

Figure 3:
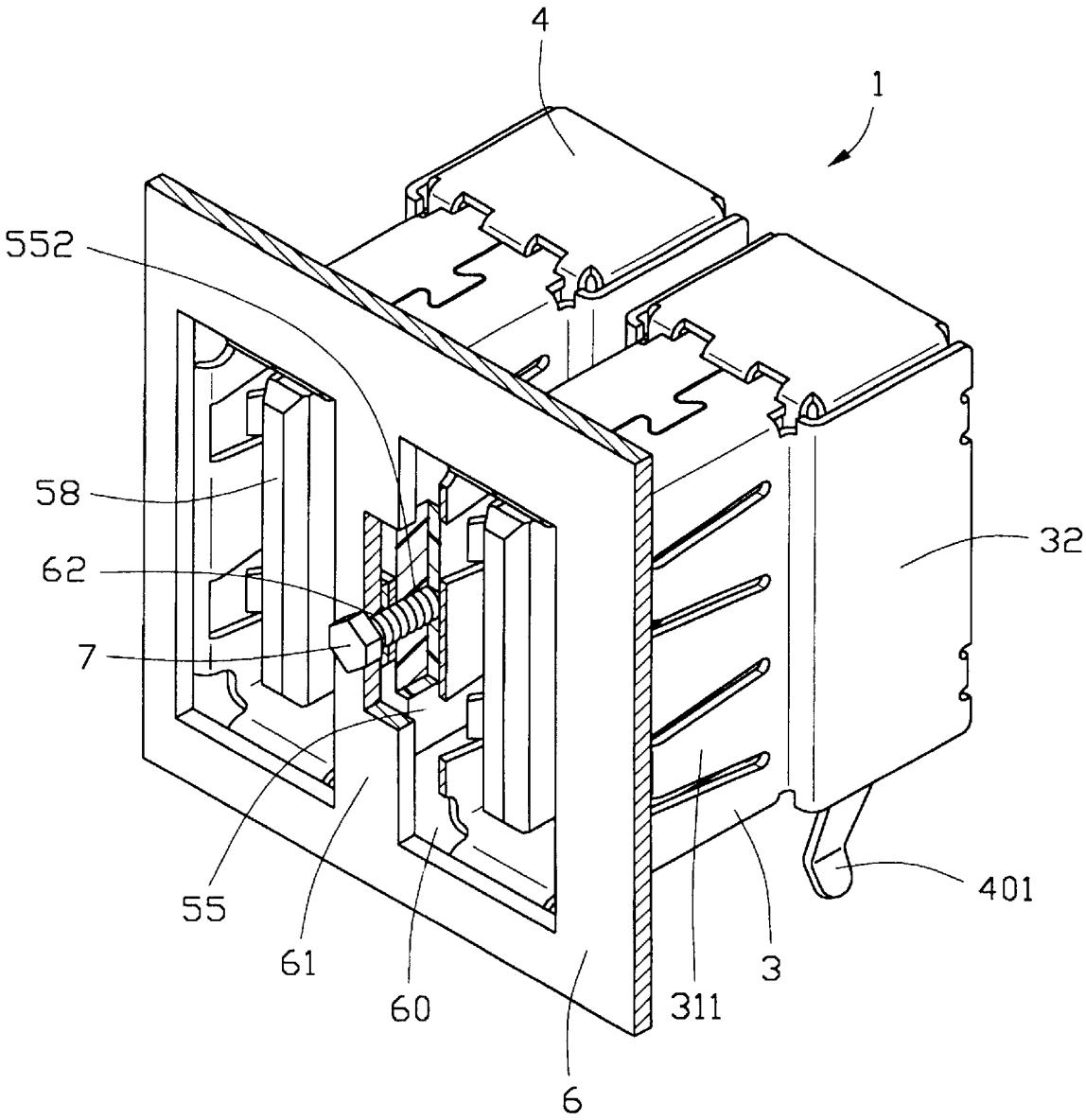
FIG. 3 is a perspective view of an electrical connector assembly mounted on a shell with parts broken away illustrated the details of the present invention.
Figure 4:
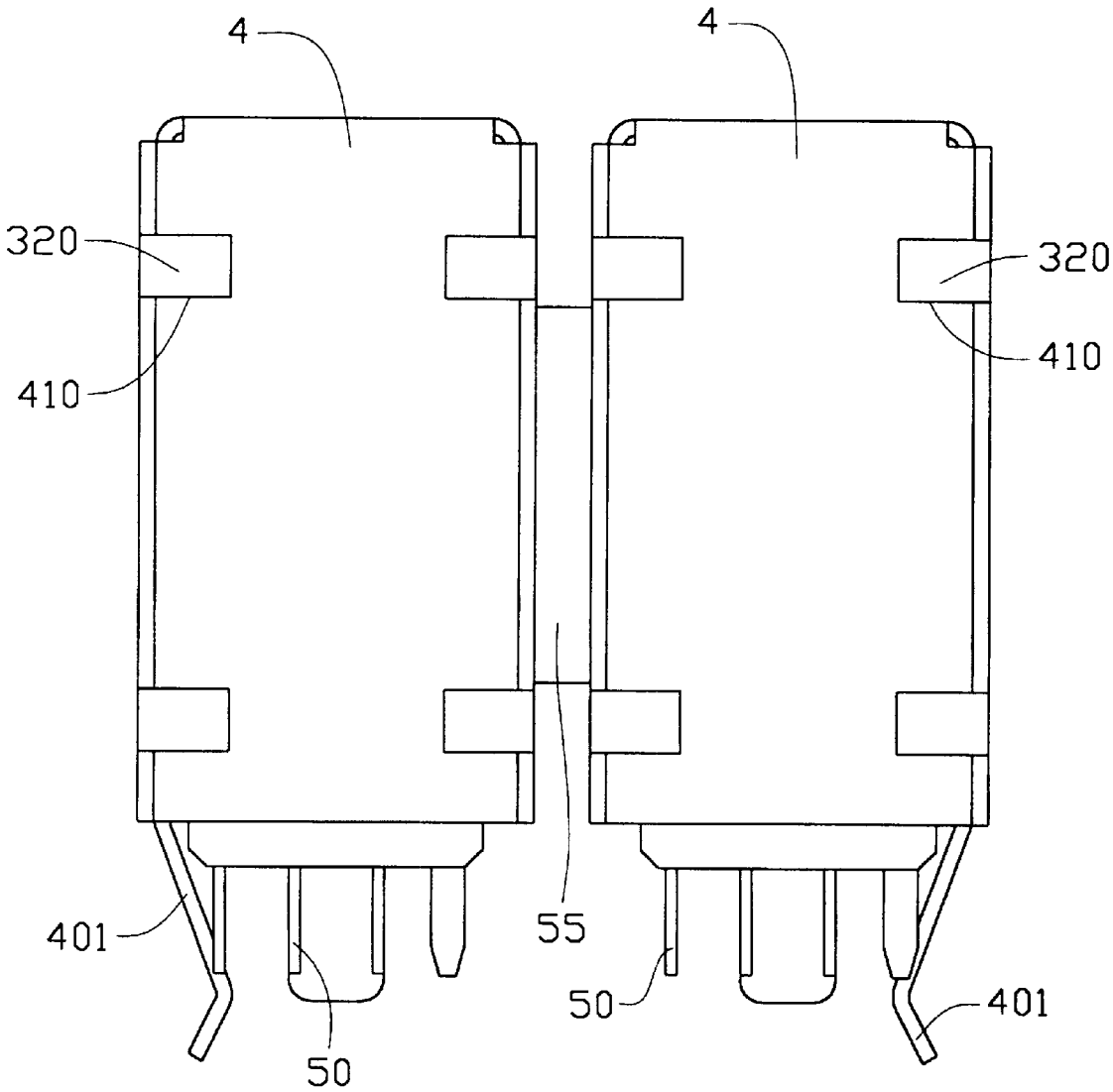
FIG. 4 is a rear elevational view of an electrical connector assembly of the present invention.

Referring to FIG. 3, the electrical connector assembly 1 is mounted on for example a conductive shell/panel 6 of an electrical device, such as a personal computer. The shell 6 has two rectangular holes 60 corresponding to the front shell 3 of the connector assembly 1 with a crossbar 61 formed therebetween. A circular hole 62 forms on the crossbar 61 having a similar diameter to the through holes 314 and the threaded hole 552. A nut 7 extends through the circular holes 62 and the through holes 314 and engages with the threaded hole 552 to fix the connector assembly 1 on the electrical device shell 6. As the front shells 3 are fixed on certain position, it is not easy to vibrate when the connector assembly 1 engages with a mating electrical connector or effected by unexpected external force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for mounting on a print circuit board (PCB) and to an electrical device shell, comprising:

a pair of electrical connectors each including an insulative housing, a front metal shell having a pair of side walls, a rear metal shell and a plurality of terminals for soldering to a printed circuit board, an ear portion extending from one of the side walls of each front shell and having a through hole, the through holes being aligned with each other when the front shells are mounted on said pair of insulative housings;

a conductive panel positioned in front of said pair of connectors and defining two openings, to expose mating ports of said two connectors, with a crossbar therebetween;

an insulative board formed between the insulative housings of the electrical connectors and extending forward, a hole being formed on a front face of the insulative board and aligned with the through holes for receiving a fastener extending through the electrical device shell; wherein the insulative housing includes a front section defining a plurality of passageways thereon and a rear section having a plurality of latches formed on opposite sides thereof; wherein the insulative board is formed together with the rear sections of the housings; wherein each of the front shells includes a receiving opening enclosed by a bottom wall, a top wall and two side walls for receiving the front section of the insulative housing therein, a pair of inserting plates respectively extending rearward from the side walls, each inserting plate forming a plurality of latching fingers at a rear edge thereof, one of said inserting plates further having a cutout.

2. The electrical connector assembly as claimed in claim 1, wherein each of the front shells has a guiding portion, the guiding portion having four parts respectively extending outward from edges of the side walls, the top wall and the bottom wall of the front shell for guiding a mating electrical connector into the receiving opening, the ear portion extends outward from the guiding portion.

3. The electrical connector assembly as claimed in claim 1, wherein the rear shell includes a top wall, a pair of side walls and a rear wall and receiving the rear section of the insulative housing, a latching tongue extending downward from the side wall for mounting to the printed circuit board, each side wall engaging with a corresponding inserting plate of the front shell and defining a plurality of latching holes for engaging with the latches of the insulative housing, the rear wall defining a plurality of apertures for receiving the latching fingers of the front shell.

4. The electrical connector assembly as claimed in claim 1, wherein a plurality of strips is stampingly formed in the side walls of the front shell, each strip having a curved end for pressing against a mating electrical connector.

5. The electrical connector assembly as claimed in claim 4, wherein a plurality of tabs extends from a rear edge of the top wall of the front shell, a flange depends downward from the top wall of the rear shell with a plurality of first recesses corresponding to the tabs of the front shell defined therein, and a step is formed between the front section and the rear section of the insulative housing for mating with the flange of the rear shell.

6. The electrical connector assembly as claimed in claim 5, wherein a plurality of second recesses is defined at an edge of the step of the insulative housing and cooperates with the first recesses of the rear shell for receiving the tabs of the front shell.

* * * * *